US008793916B2

(12) United States Patent
Rogers et al.

(10) Patent No.: US 8,793,916 B2
(45) Date of Patent: Aug. 5, 2014

(54) FIREARM SLING ASSEMBLY, RELATED MECHANISMS AND METHODS

(75) Inventors: William H. Rogers, St. Augustine, FL (US); Matthew E. McKendrick, Jacksonville, FL (US)

(73) Assignee: Prezine, LLC, Jacksonville, FL (US)

( * ) Notice: Subject to any disclaimer, the term of this patent is extended or adjusted under 35 U.S.C. 154(b) by 402 days.

(21) Appl. No.: 13/059,514

(22) PCT Filed: Sep. 8, 2009

(86) PCT No.: PCT/US2009/056177

§ 371 (c)(1),
(2), (4) Date: Feb. 17, 2011

(87) PCT Pub. No.: WO2010/028337

PCT Pub. Date: Mar. 11, 2010

(65) Prior Publication Data

US 2011/0138671 A1 Jun. 16, 2011

Related U.S. Application Data

(60) Provisional application No. 61/094,665, filed on Sep. 5, 2008.

(51) Int. Cl.
*F41C 23/02* (2006.01)

(52) U.S. Cl.
USPC ..... 42/85; 24/2.5

(58) Field of Classification Search
USPC ..... 42/85; 224/150; 24/608, 607, 2.5
See application file for complete search history.

(56) References Cited

U.S. PATENT DOCUMENTS

| | | | | |
|---|---|---|---|---|
| 3,061,965 | A * | 11/1962 | Lewis | 42/85 |
| 4,144,794 | A * | 3/1979 | Silverman et al. | 84/327 |
| 2006/0208016 | A1 | 9/2006 | Esch | |
| 2006/0254113 | A1 | 11/2006 | Esch | |

FOREIGN PATENT DOCUMENTS

| | | |
|---|---|---|
| KR | 200378458 | 3/2005 |
| WO | 2008044997 | 4/2008 |

OTHER PUBLICATIONS

International Search Report and written opinion dated Apr. 26, 2010 for PCT/US2009/056177: issued by the International Searching Authority, entire document.

* cited by examiner

*Primary Examiner* — Daniel J Troy
(74) *Attorney, Agent, or Firm* — Arthur G. Yeager

(57) ABSTRACT

A firearm sling assembly includes an anchor adapted for connection to a firearm, a strap forming a single loop and adapted for wearing around a user's neck, and a quick-release mechanism releasably attaching the anchor to the strap. The quick-release mechanism includes a first element having a key groove defined therein, a second element having a key channel defined therein, the key channel extending between a first opening adjacent the key groove and a second opening away from the key groove, a key slidably disposed in the key channel and retractably engaging the key groove through the first opening, a biasing element acting between the key and second element to bias the key into engagement with the key groove, and a release element disposed on the second element and displaceable relative thereto to disengage the key from the key groove.

13 Claims, 5 Drawing Sheets

FIREARM SLING ASSEMBLY, RELATED MECHANISMS AND METHODS

CROSS-REFERENCE TO RELATED APPLICATION

This application is the 371 National Stage of International Application No. PCT/US2009/056177 filed on Sep. 8, 2009, which claims the benefit of U.S. Provisional Application Ser. No. 61/094,665, filed on Sep. 5, 2008, the contents of which applications, are hereby incorporated by reference in their entirety.

FIELD OF THE INVENTION

The present invention relates to firearm slings, and more particularly, to single point rifle slings and their use.

BACKGROUND OF THE INVENTION

Rifle slings have been used by the military since the introduction of firearms in warfare. In the beginning, a sling was mainly necessary to support the weight of a weapon during long marches. A two-point sling, in which one end of an adjustable strap is attached to a forearm of a rifle and the other end is attached to a butt stock, became the most dominant design. An operator positioned the rifle over one shoulder toward his back, where it was carried hands-free. In this position, the operator's forward movement did not cause the rifle to swing from its position on his back to bump his body with each step. Although this sling design supported the rifle during long marches, it did not provide immediate firing access. Two-point slings similar to the original designs are still in use.

In recent years, the single-mount sling has been introduced. This sling attaches near the midpoint of the rifle and supports the rifle in front of an operator's body. The single-mount sling offers immediate transition to a firing position from the "patrol ready" position. This type of sling, however, typically uses metal clasps or clips that require two hands to operate, precluding a simple or quick transition to other shooting positions or the stowing of a rifle behind an operator's back.

To make single-point sling designs more useful bungee cords have been used to attach the sling to the rifle. These bungee designs, however, have proven to be dangerous. For example, a rifle carried hands-free can become snagged, resulting in the rifle inadvertently releasing from the sling. This can result in the butt stock of the weapon forcefully impacting the operator's chin or other parts of his face.

SUMMARY OF THE INVENTION

In view of the foregoing, it is an object of the present invention to provide an improved firearm sling assembly. According to an embodiment of the present invention, a firearm sling assembly includes an anchor adapted for connection to a firearm, a strap forming a single loop and adapted for wearing on a user's shoulder, and a quick-release mechanism releasably attaching the anchor to the strap.

According to an aspect of the present invention, the quick-release mechanism includes a first element having a key groove defined therein, a second element having a key channel defined therein, the key channel extending between a first opening adjacent the key groove and a second opening away from the key groove, a key slidably disposed in the key channel and retractably engaging the key groove through the first opening, a biasing element acting between the key and second element to bias the key into engagement with the key groove, and a release element disposed on the second element and displaceable relative thereto to disengage the key from the key groove. The disengagement of the key from the key groove allows detachment of the first and second elements.

According to a further aspect of the present invention, all components of the sling assembly that would require operation in a tactical situation, or be subject to repeated contact with the firearm, metallic items on the user, or other metallic equipment, are formed from non-metallic materials to prevent metal clanging and minimize noise.

According to an additional aspect of the present invention, the sling assembly includes a locking element releasably engaging the release element to prevent disengagement of the key from the key groove.

According to a method aspect, a method of using the sling assembly with a firearm includes attaching the anchor to the firearm, arranging the strap on a user's shoulder such that the quick-release mechanism is moveable between a user's front and back without removal of the strap, and operating the quick-release mechanism to alternately attach and detach the rifle from the strap.

These and other objects, aspects and advantages of the present invention will be better understood in view of the drawings and following detailed description of preferred embodiments.

DETAILED DESCRIPTION OF A PREFERRED EMBODIMENT

Figure 1:
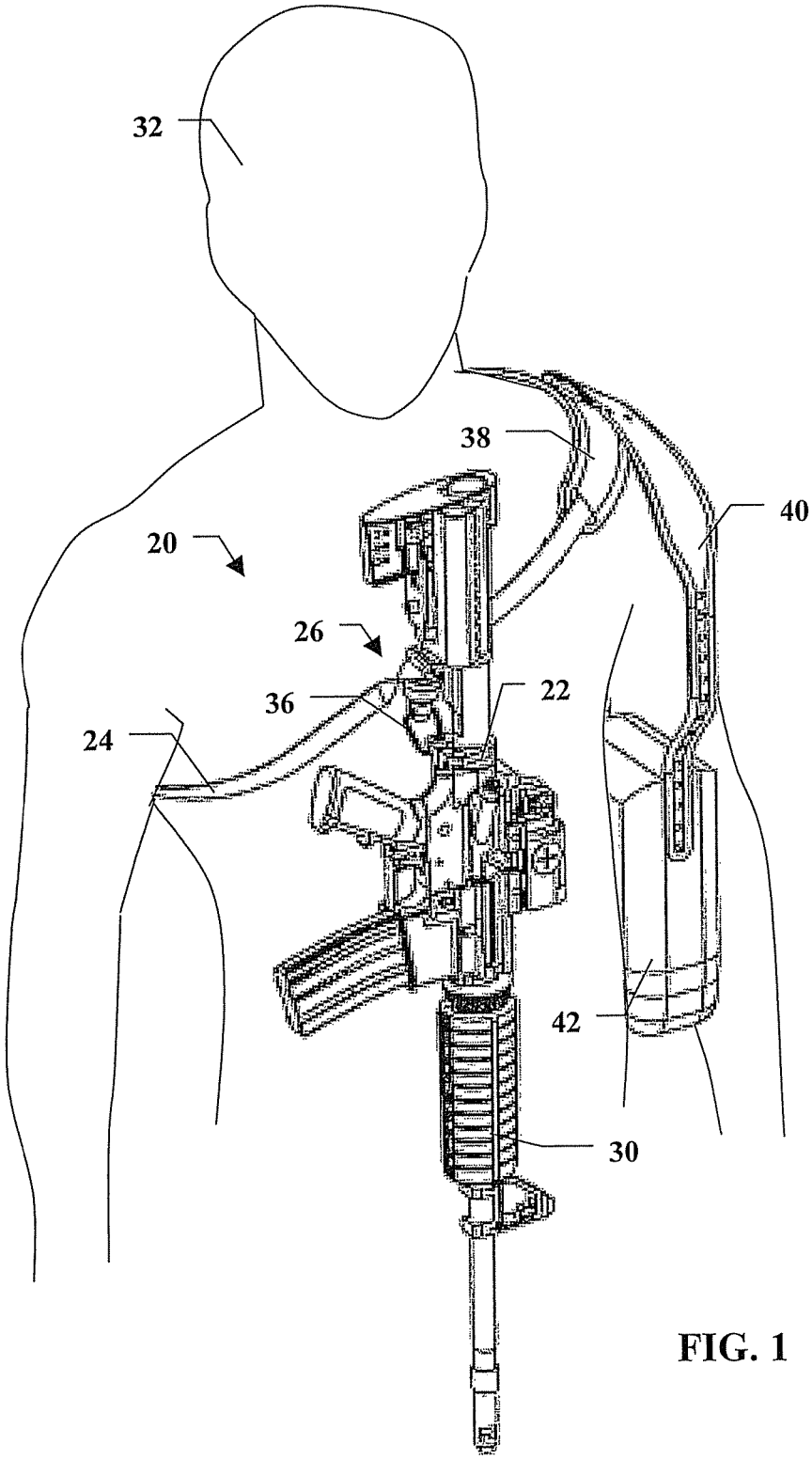
FIG. 1 is a perspective view of a firearm shoulder sling assembly, including an anchor, a strap and a quick-release mechanism, being worn by a user and holding a firearm, according to an embodiment of the present invention.
Figure 2:
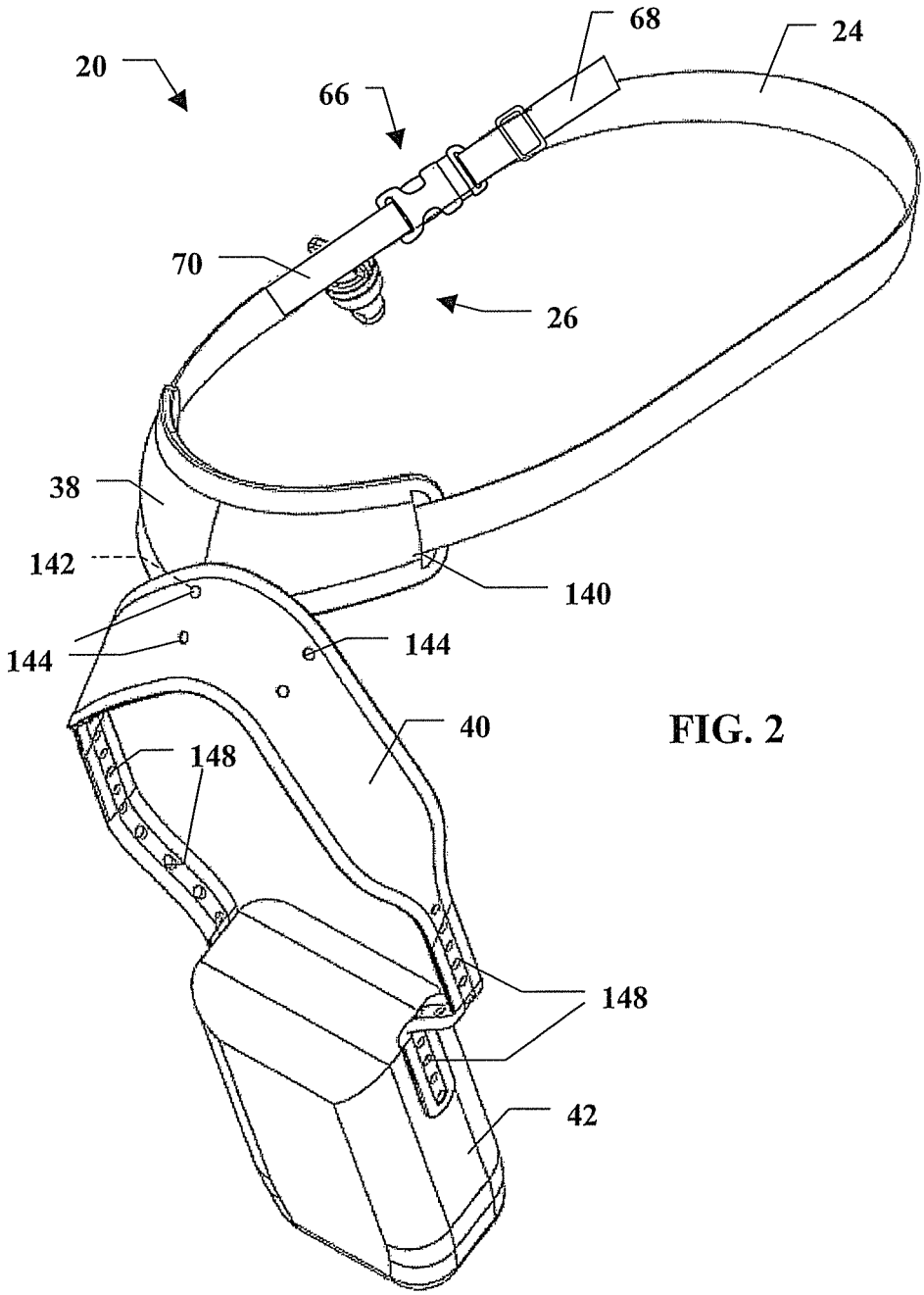
FIG. 2 is a perspective view of the strap of the firearm sling assembly of FIG. 1.

According to an embodiment of the present invention, referring to FIGS. 1 and 2, a firearm sling assembly 20 includes an anchor 22, a strap 24 and a quick-release mechanism 26. The anchor 22 is adapted for connection to a firearm 30, such as a rifle, and most preferably to the rifle stock rearward of the trigger. The strap 24 forms a single loop is adapted for wear on the shoulder of a user 32, extending over one shoulder and under the opposite shoulder. The quick-release mechanism 26 releasably attaches the anchor 22 to the strap 24. Preferably, a short cord 36 connects the anchor 22 with the quick-release mechanism 26. The sling assembly 20 further includes a shoulder pad 38 through which the strap 24 is slidably routed, an accessory strap 40 removably connected to the shoulder pad 38, and an accessory 42, such as a magazine holder, removably suspended from the accessory strap 40.

Although in FIG. 1 the firearm 30 is shown slung in a hands-free front position, allowing the user 32 to perform other manual tasks, such as using another firearm. However, it will be appreciated that, without requiring detachment of the firearm 30, the sling assembly 20 also permits carrying the firearm in a "patrol ready" position, moving the firearm 30 to a rear hands-free position, and using the firearm 30 with either hand from standing, kneeling and seated firing positions. Transitions between these positions can be made quickly and without removal of the strap 24 from the firearm 30. Additionally, the quick-release mechanism 26 allows easy, one-handed release of the firearm 30 from the remainder of the sling assembly 20, for instance, for tactical reasons or if the firearm 30 becomes entrapped. Most preferably, all components of the sling assembly 20 that would require operation in a tactical situation, or be subject to repeated contact with the firearm 30, metallic items on the user 32, or other metallic equipment, are formed from non-metallic materials to prevent metal clanging and minimize noise.

Figure 3:
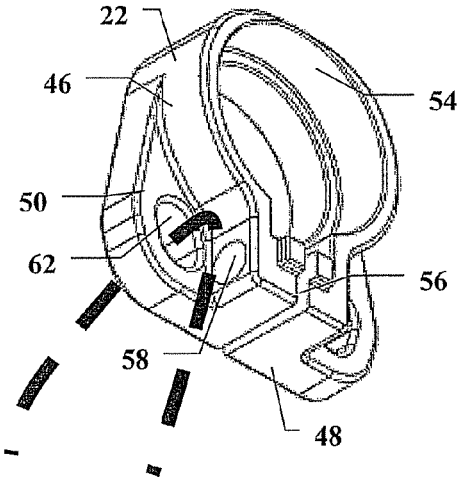
FIG. 3 is a perspective view of the anchor of FIG. 1.
Figure 4:
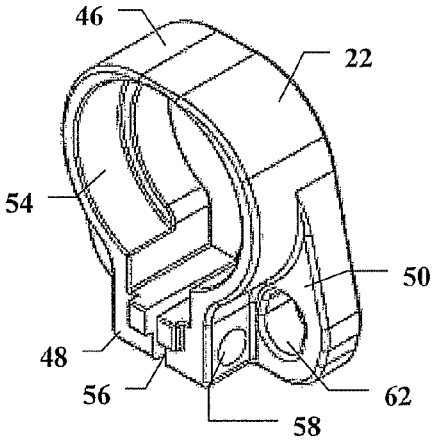
FIG. 4 is another perspective view of the anchor of FIG. 1.

Referring to FIGS. 3 and 4, the anchor 22 has a central portion 46, a lower portion 48 and wings 50. A stock passage 54 is defined extending through the central portion 46. The stock passage 54 communicates with a slit 56 defined in the lower portion 48. A tensioner passage 58, such as a threaded bore, is also defined in the lower portion 48 approximately perpendicular with, and intersected by, the slit 56. Cord holes 62 are defined extending through the wings 50 and are adapted to receive the cord 36 therethrough.

Figure 5:
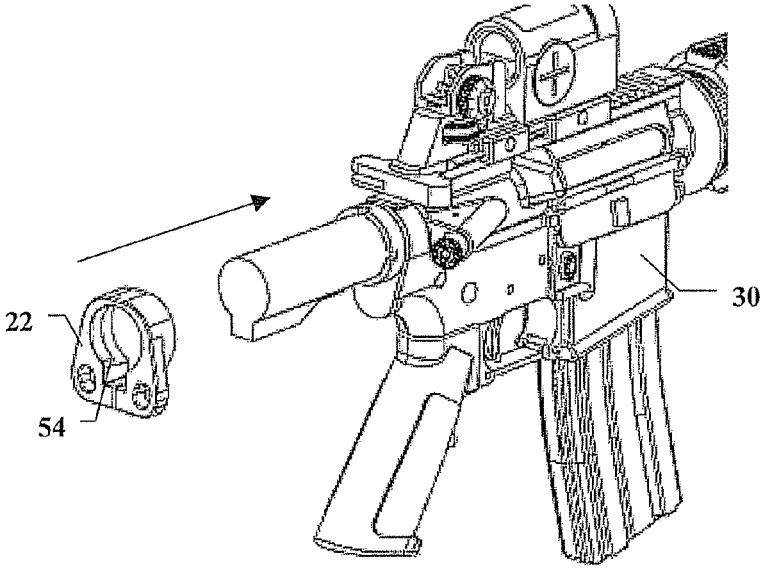
FIG. 5 is a perspective view of the attachment of the anchor of FIG. 1 to a firearm.

Referring to FIG. 5, to attach the anchor 22 to the firearm 30, the firearm 30 butt stock is removed and the stock passage 54 of the anchor 22 is arranged around the exposed portion of the stock. A screw or other tensioner is used in the tensioner passage 58 to tightly secure the central portion 46 around the stock. The butt stock is replaced and the firearm 30 is ready for use in connection with the sling assembly 20. Although the anchor 22 is shown in use with a firearm 30 having a removable butt stock, it will be appreciated that the anchor 22 could be adapted to other types of firearms. Moreover, multiple anchors 22 could be used with different firearms, such that the user 32 would not need to exchange the anchor 22 when different firearms are desired to be used in connection with the sling assembly 20. The anchor 22 is preferably formed of a non-metallic material, such as injection-molded plastic.

Referring again to FIG. 2, the strap 24 preferably includes a buckle assembly 66, or other releasable connector to facilitate donning and doffing of the strap 24 by the user 32. The buckle assembly 66 advantageously also allows for adjusting the size of the loop formed by the strap 24 by adjusting a free end 68 of the strap 24. Preferably, the loop size is adjusted such that the quick-release mechanism 26 will hang at or near the sternum of the user 32. Additionally, a fixed end 70 of the strap 24 can be secured over an attachment point of the quick-release mechanism 26, such that movement of the quick-release mechanism 26 results in sliding of the strap 24 about the body of the user 32 and vice versa. The strap 24 is preferably formed of a flat, woven fabric. The buckle assembly 66 is preferably formed of non-metallic materials, such as injection molded plastic.

Figure 6:
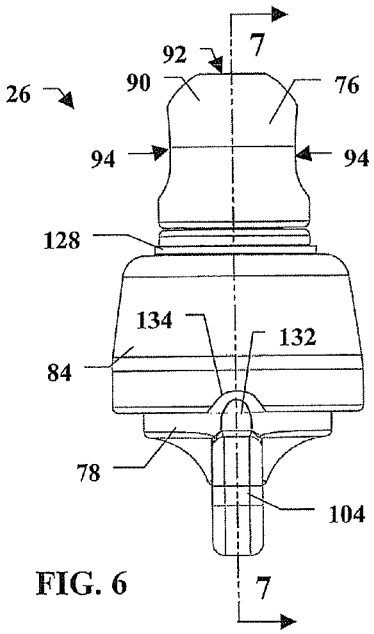
FIG. 6 is a side view of the quick-release mechanism of FIG. 1, in an engaged position.
Figure 7:
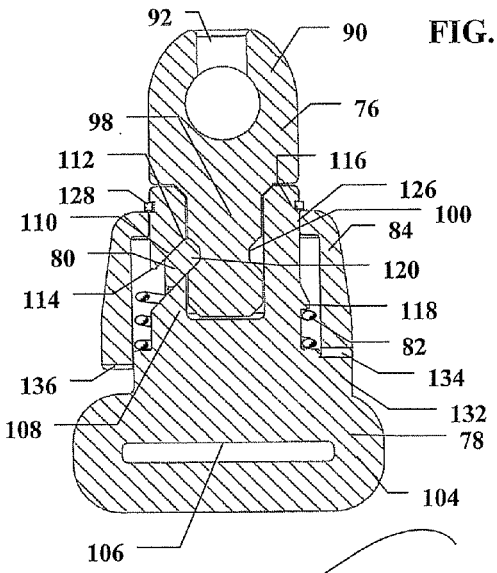
FIG. 7 is a sectional view taken along line 7-7 of FIG. 6.
Figure 8:
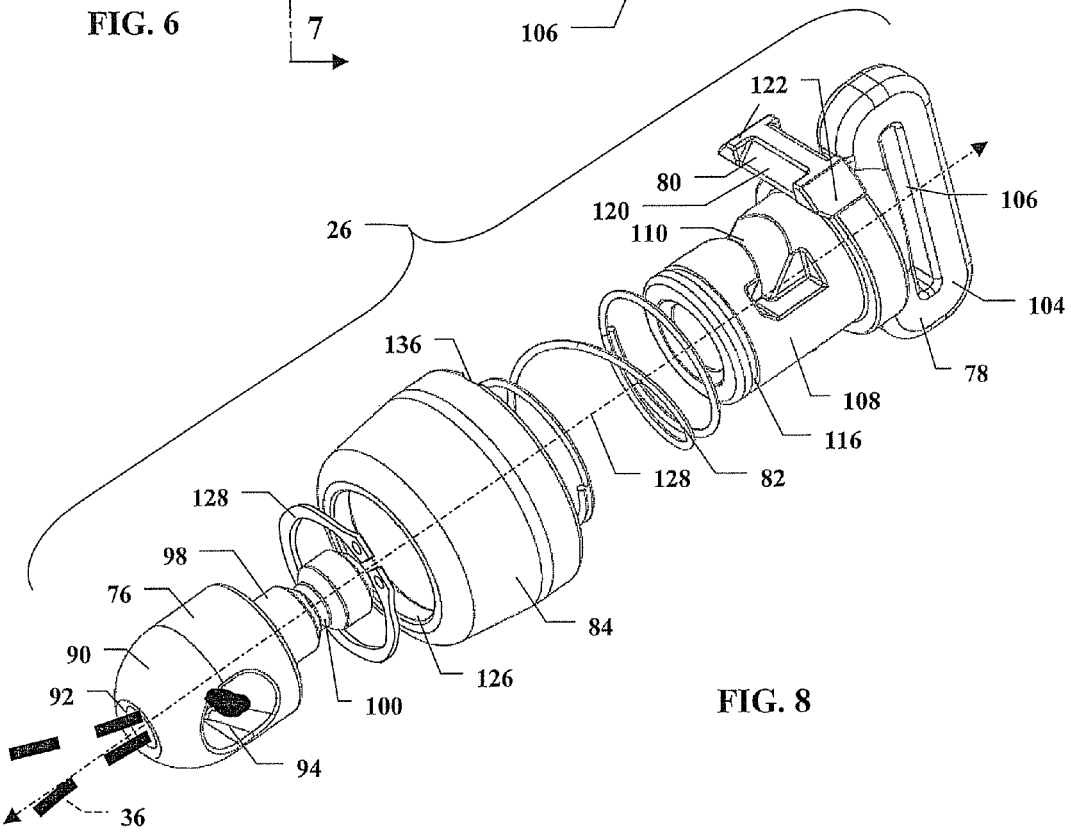
FIG. 8 is an exploded view of the quick-release mechanism of FIG. 1.

Referring to FIGS. 6-8, the quick-release mechanism 26 includes complementary first and second elements 76, 78, a key 80, a biasing element 82, such as a spring, and a release element 84, such as a collar surrounding the second element 78. The biasing element 82 biases the key 80 into mutual engagement with both the first and second elements 76, 78 (as seen in FIG. 7), preventing detachment of the first and second elements. The release element 84 is displaceable to move the key 80 out of mutual engagement, allowing detachment of the first and second elements 76, 78. Advantageously, only one hand of the user 32 is required to operate the quick-release mechanism. Also, the first and second elements 76, 78, key 80, biasing element 82 and a release element 84 are all preferably formed of non-metallic materials, such as injection-molded plastic.

The first element 76 includes a cord attachment portion 90 for receiving the cord 36. Preferably, opposite ends of the cord 36 are routed through a central opening 92 and out respective side openings 94. The cord 36 ends then are knotted to prevent withdrawal through the central opening 92, and the knotted ends are pulled back into the cord attachment portion 90. The first element 76 further includes a male portion 98 having a key groove 100 defined therein, for example, as an annular channel. The key groove 100 is adapted for engagement with the key 80.

The second element 78 has a strap attachment portion 104 with a strap passage 106 defined therein for slidably receiving the strap 24 therethrough. The second element 78 also has a female portion 108 with a key channel 110 defined therein, in which the key 80 is slidably disposed. The key channel 110 extends between a first opening 112 adjacent to the key groove 100 and a second opening 114 away from the key groove 100. Additionally, a retention element groove 116 is defined around an end of the female portion 108. A biasing element protrusion 118 can also extend outward from the female portion 108 to help retain the biasing element 82 in place about the female portion 108. Alternately, the protrusion 118 can be omitted, with the biasing element being held in place by engagement with the key 80.

The key 80 has an engagement portion 120, which enters the key channel 110 and is extendable through the first opening 112 into the key groove 100, and end portions 122, which extend outside the second opening 114. The end portions 122 are engaged by the biasing element 82 and biased thereby such that the engagement portion 120 is urged further toward the first opening 112. The end portions 122 are also engageable by the release element 84 to urge the engagement portion 120 away from the first opening 112.

The release element 84 is arranged to be slidably and rotatably displaceable about the female portion 108. The release element 84 includes a reduced diameter opening 126, adapted to engage the end portions 122 of the key 80. A retention element 128, such as a snap ring, can be fitted into the retention element groove 116 to retain the release element 84 about the female portion 108.

Figure 9:
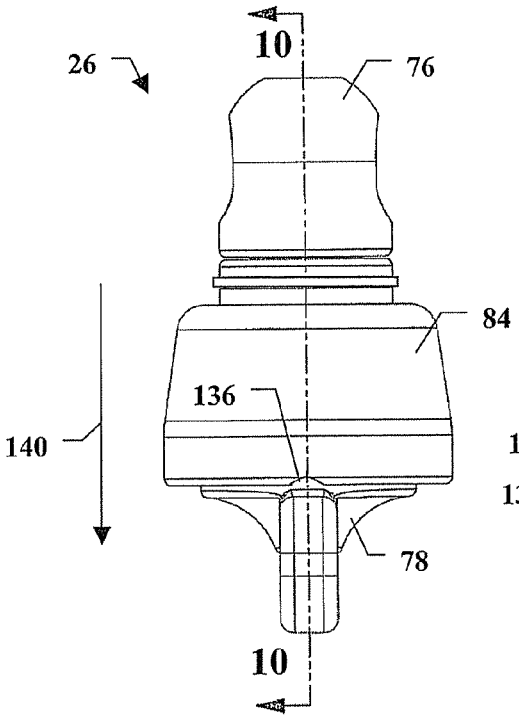
FIG. 9 is an opposite side view of the quick-release mechanism of FIG. 1, in a disengaged position.
Figure 10:
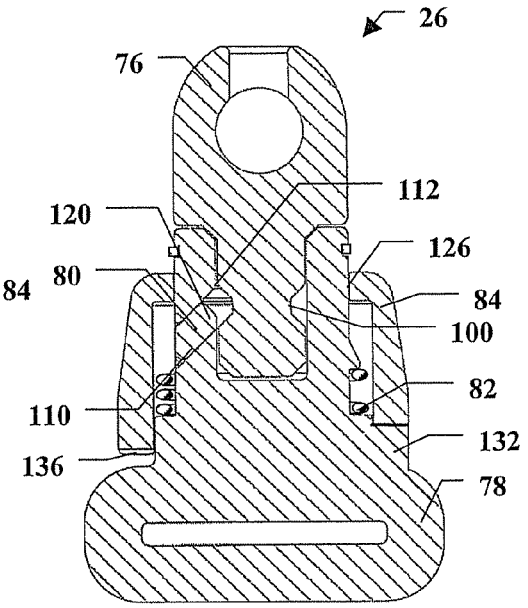
FIG. 10 is a sectional view taken along line 10-10 of FIG. 9.

Referring to FIGS. 9 and 10, to detach the first and second elements 76, 78, the release element 84 is slidably displaced in direction 140. As a result, the reduced diameter opening 126 engages the end portions 122 (see FIG. 8) of the key 80, forcing the key 80 away from the first opening 112 of the key channel 110 against the force of the biasing element 82. The engagement portion 120 moves out the key groove 100, and the first element 76 can be detached from the second element 78.

The first and second elements 76, 78 are detachable along a detachment axis 128. The channel 110 is arranged at a non-perpendicular angle to the detachment axis 128 such that attempted detachment of the first and second elements 76, 78 without use of the release element 84 will tend to further urge the key 80 into engagement with the key groove 100, thereby minimizing the likelihood of inadvertent detachment. However, when the first and second elements are being re-attached, the angle of the channel 110 will allow the key 80 to be forced into the channel 110 without use of the release element 84. Thus, the first element 76 can be completely inserted. When the key groove 100 is aligned with the first opening 112, the key 80 will automatically move back into engagement with the key groove 100 under the force of the biasing element 82.

Referring to FIGS. 6 and 7, the quick-release device 26 can also include a locking element 132 to help prevent inadvertent detachment. The locking element 132 protrudes from the second element 78 toward an edge of the release element 84. The release element 84 includes a first notch 134. When aligned with the locking element 132, as in FIGS. 6, 7, 9 and 10, the depth of the first notch 134 allows sufficient displacement of the release element 84 to disengage the key 80. By rotating the release element 84 such that the locking element 132 is out of alignment with the first notch 134, the release element 84 cannot be displaced far enough to disengage the key 80. A second notch 136 can also be formed on the release element 84, which is shallow enough prevent sufficient release element 84 displacement to disengage the key 80. However, when rotated into engagement, the second notch 136 engages the locking element 132 thereby resisting inadvertent rotation.

Although the illustrated first and second elements 76, 78 constitute a preferred embodiment, it will be appreciated that male and female portions could be reversed. Also, a key groove could be formed in the female portion with a key displaceable with a key channel defined extending into a hollow male portion.

Referring again to FIG. 2, the shoulder pad 38 helps prevent chaffing and rubbing of the strap 24 against the user. For right-handed shooters, the pad 38 is preferably positioned over the left shoulder, adjacent where the neck meets the shoulder. The reverse is preferable for left-handed shooters. A tunnel 140 is defined extending through the shoulder pad 38, through which the strap 24 is slidably guided. Preferably pad 38 has a bottom surface oriented towards the body of a user that is anti-slip, for example a roughened rubberized surface. An accessory strap connection point 142 for the accessory strap 40 is located near an apex of the pad 24. It will be appreciated, however, that the sling assembly 20 could be used without the shoulder pad 38; for instance, with users having utility vests or other garments that would be effective to minimize rubbing and chaffing.

The accessory strap 40 includes multiple pad connection points 144, each of which is complementary with the connection point 142; for example, a plurality of snaps. The multiple points 144 allow the user 32 to adjust the hang of the accessory strap 40 from the user's shoulder. The accessory strap 40 further includes a plurality of accessory connection points 148, allowing the user 32 to adjust the hang of the accessory 42 from the strap 40. Advantageously, suspending the accessory strap 40 from the shoulder pad 38 allows the strap 24 to be moved about the torso of the user 32 without requiring movement of the accessory strap 40 and accessory 42. It will be appreciated, however, that the sling assembly 20 can be used without the accessory strap 40 and accessory 42.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and the claims appended hereto.

What is claimed is:

1. A firearm sling assembly comprising:

an anchor adapted for connection to a firearm;

a cord connected to the anchor;

a strap forming a single loop and adapted for wearing on a user's shoulder; and a quick-release mechanism having first and second elements releasably attaching the anchor to the strap, the first element being connected to the anchor by the cord, the second element being connected to the strap, said mechanism when released having a first element remaining with said anchor and said second element remaining with said strap, the quick-release mechanism including a release element disposed around the second element, while the first and second elements are attached the release element being movable away from the first element to allow detachment of the quick-release mechanism, wherein at least one of the first and second elements includes a locking element for selectively engaging the release element.

2. The assembly of claim 1, wherein the anchor and the first and second elements consist of non-metallic materials.

3. The assembly of claim 1, wherein the anchor includes an anchor body with a stock passage defined therein to accommodate a portion of a stock of the firearm.

4. The assembly of claim 1, wherein the strap includes a buckle assembly.

5. The assembly of claim 1, wherein the quick-release mechanism is adapted for one-handed operation.

6. The assembly of claim 1, wherein the first element includes a male portion and remains connected to the anchor after detachment of the quick-release mechanism.

7. The assembly of claim 1, further comprising a shoulder pad relatively slidably disposed on the strap.

8. The assembly of claim 7, further comprising an accessory strap releasably connected to the shoulder pad.

9. The assembly of claim 1, wherein the first element includes a male portion and the second element includes a female portion.

10. The assembly of claim 1, wherein the first and second elements and the release element consist of non-metallic materials.

11. A firearm sling assembly comprising:

an anchor adapted for connection to a firearm a cord connected to the anchor;

a strap forming a single loop and adapted for wearing on a user's shoulder; and a quick-release mechanism including:

a first element connected to the anchor by the cord and having a male portion with a key groove defined therein;

a second element connected to the strap and having a female portion with a key channel defined therein, the key channel extending between a first opening adjacent the key groove and a second opening away from the key groove;

a key slidably disposed in the key channel and retractably engaging the key groove through the first opening;

a biasing element acting between the key and second element to bias the key into engagement with the key groove; and a release element movable toward the strap and disposed on the second element and displaceable relative thereto to disengage the key from the key groove;

wherein the disengagement of the key from the key groove allows detachment of the first and second elements with the first element remaining with the anchor and the second element remaining with the strap.

12. The assembly of claim 11, further comprising a shoulder pad relatively slidably disposed on the strap.

13. The mechanism of claim 11, wherein the first and second elements and the release element consist of non-metallic materials.

* * * * *